US006915535B2

(12) United States Patent
Sieger et al.

(10) Patent No.: US 6,915,535 B2
(45) Date of Patent: Jul. 12, 2005

(54) SANITARY TUB

(75) Inventors: Christian Sieger, Sassenberg (DE); Michael Sieger, Sassenberg (DE)

(73) Assignee: Franz Kaldewei GmbH & Co. KG, Ahlen (DE)

( * ) Notice: Subject to any disclaimer, the term of this patent is extended or adjusted under 35 U.S.C. 154(b) by 17 days.

(21) Appl. No.: 10/705,655

(22) Filed: Nov. 10, 2003

(65) Prior Publication Data

US 2004/0221383 A1 Nov. 11, 2004

(30) Foreign Application Priority Data

Nov. 19, 2002 (DE) ..... 102 54 004

(51) Int. Cl.[7] ..... A47K 3/00
(52) U.S. Cl. ..... 4/559; 4/584; 4/591
(58) Field of Search ..... 4/559, 571.1, 573.1, 4/574.1, 575.1, 576.1, 577.1, 579, 584, 591

(56) References Cited

U.S. PATENT DOCUMENTS

| | | | | | |
|---|---|---|---|---|---|
| 1,198,303 | A | * | 9/1916 | Williams | 4/591 |
| 1,512,193 | A | * | 10/1924 | Berven | 4/591 |
| 2,679,652 | A | * | 6/1954 | Eyring | 4/591 X |
| 4,080,710 | A | * | 3/1978 | Hess | 4/584 X |

FOREIGN PATENT DOCUMENTS

| | | |
|---|---|---|
| DE | 29819364 | 4/1999 |

* cited by examiner

*Primary Examiner*—Robert M. Fetsuga
(74) *Attorney, Agent, or Firm*—Collard & Roe, P.C.

(57) ABSTRACT

A sanitary tub has a tub body with a tub edge on the perimeter of the tub body that has been turned towards the outside. The tub edge has a substantially vertical collar on its circumference. A carrier secured to a tub edge covering is attached to the collar. The carrier has a bottom edge arranged at a distance above the tub edge which, together with the tub edge, form a groove that is open towards the interior of the tub body.

15 Claims, 3 Drawing Sheets

6
7
1
3
9
A
2

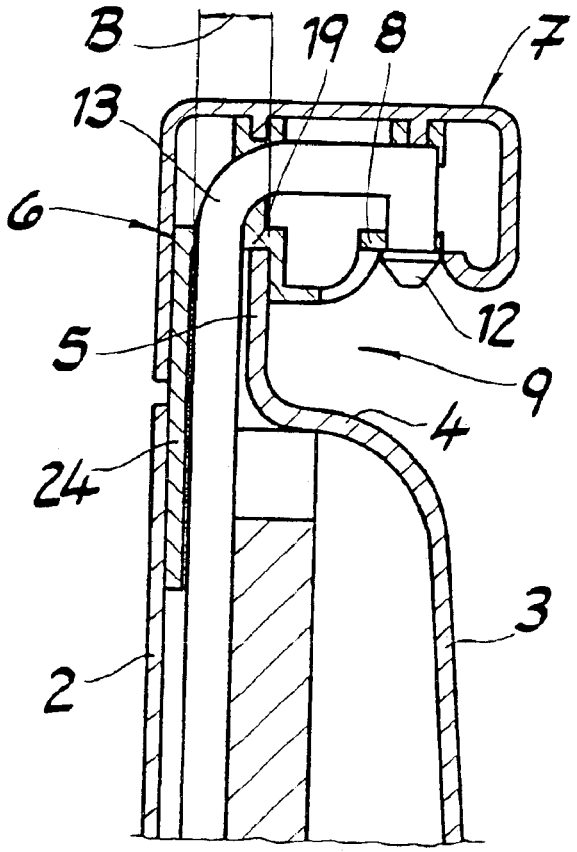
Fig.3
Fig.4
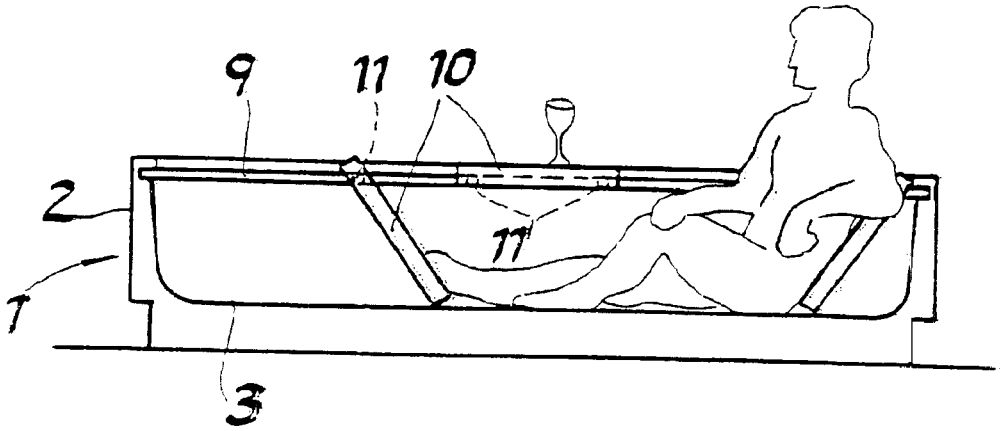

SANITARY TUB

CROSS REFERENCE TO RELATED APPLICATIONS

Applicant claims priority under 35 U.S.C. §119 of German Patent Application No. 102 54 004.7 filed Nov. 19, 2002.

BACKGROUND OF THE INVENTION

1. Field of the Invention

The invention relates to a sanitary tub having a tub body with a tub edge that has been turned towards the outside, whereby the tub edge ends with an up-drawn collar. The tub body consists, for example, of enameled sheet steel, a deep-drawn plastic shell, or a laminate material having an outer shell made of sheet steel and an inner shell of plastic. Within the scope of the invention, tub bodies having a high level of shape rigidity are preferred.

2. Prior Art

A sanitary tub having the characteristics described initially is known from DE 298 19 364 U1. The up-drawn collar of the tub edge lies against a wall surface, interposed by a seal. The wall surface is tiled above the tub edge, whereby the first row of tiles lies against the outside of the seal arranged on the collar and covers it.

At the entry side of the sanitary tub, away from the wall, the tub edge is usually not configured with an up-drawn edge. Here, the tub edge is usually configured as an essentially level surface on the top and for reasons of stability is angled down in a U-shape. At the same time, the U-shaped angle forms an end edge for tub paneling and/or tiled surfaces that follow on the bottom.

In the case of high-quality baths, for aesthetic reasons there is a need to provide a tub end covering that is adapted to the room in terms of material, color, and design. Furthermore, for aesthetic reasons, technical devices, such as cleaning jets, jets for an automatic inflow of liquid bath additives, overflow openings, and the like are arranged so that they are covered.

In the case of conventional tub bodies, there is the problem that bath furniture cannot be suspended in the tub body, and accessories, for example soap dishes, cannot be attached to the tub body in movable manner.

SUMMARY OF THE INVENTION

It is an object of the present invention to improve the top end of a sanitary tub with regard to both aesthetic and functional aspects.

Proceeding from a sanitary tub having the characteristics described initially, this task is accomplished, according to the invention, in that a carrier having a tub edge covering is attached to a collar of the tub edge, wherein the carrier has a bottom edge arranged at a distance above the tub edge, which, together with the tub edge, form a groove that is open towards the interior of the tub body. The groove that is open towards the interior of the tub body makes it possible to attach accessories, for example soap dishes and the like. Furthermore, the groove can be used for hanging bath furniture, for example tray tables, back rests, and the like. For this purpose, the bath furniture has guide tabs that are engaged in the groove between the tub edge of the tub body and the carrier of the tub edge covering.

In another embodiment, the carrier for the tub edge covering forms an installation space for electrical installations and/or water installations, and functional elements of these installations are arranged on the bottom edge of the carrier. Because of their installation within the groove, the functional elements are arranged so that they are covered to a great extent. Cleaning jets or jets for feeding liquid bath substances, which are connected with lines for liquid in the installation space of the carrier, can be arranged on the bottom edge of the carrier. Furthermore, a device for illuminating the tub interior may be housed in the installation space of the carrier. The arrangement can easily be made in such a manner that the light exits from the groove that is open towards the tub interior as a band of light.

Furthermore, the up-drawn collar of the tub space can contain one or more overflow openings connected to an overflow channel. In all of the exemplary embodiments described, the technical installations are not visible or hardly visible from the outside because of their arrangement within the groove that is open towards the tub interior.

According to another preferred embodiment of the invention, the carrier has ribs having connector formations for attaching the tub edge covering. It is practical if the tub edge covering is configured as a handle profile, which surrounds the bottom edge of the carrier. With regard to material, color, and design, the tub edge covering can be structured in a variety of manners, and can be coordinated with the bath fittings. Profiles made of plastic, metal, or wood are suitable as a tub edge covering. In addition, the tub edge covering can be produced as an elastically resilient molded body, for example made of Technogel, or the tub edge covering can be made of natural stone elements.

There are various design possibilities for attaching the carrier to the up-drawn collar of the tub edge. According to a preferred embodiment, the carrier has a connection segment that is U-shaped in cross-section, which surrounds the top edge of the collar formed on the tub edge, and has a width that is sufficient to allow lines to be passed through it. The width is sized in such a manner that liquid and electrical lines to supply the installations that are provided within the carrier can be passed through.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views:

FIG. 3 shows another embodiment of the present invention, and FIG. 4 shows an example of an embodiment of the present invention in use.

DETAILED DESCRIPTION OF THE INVENTION

Figure 1:
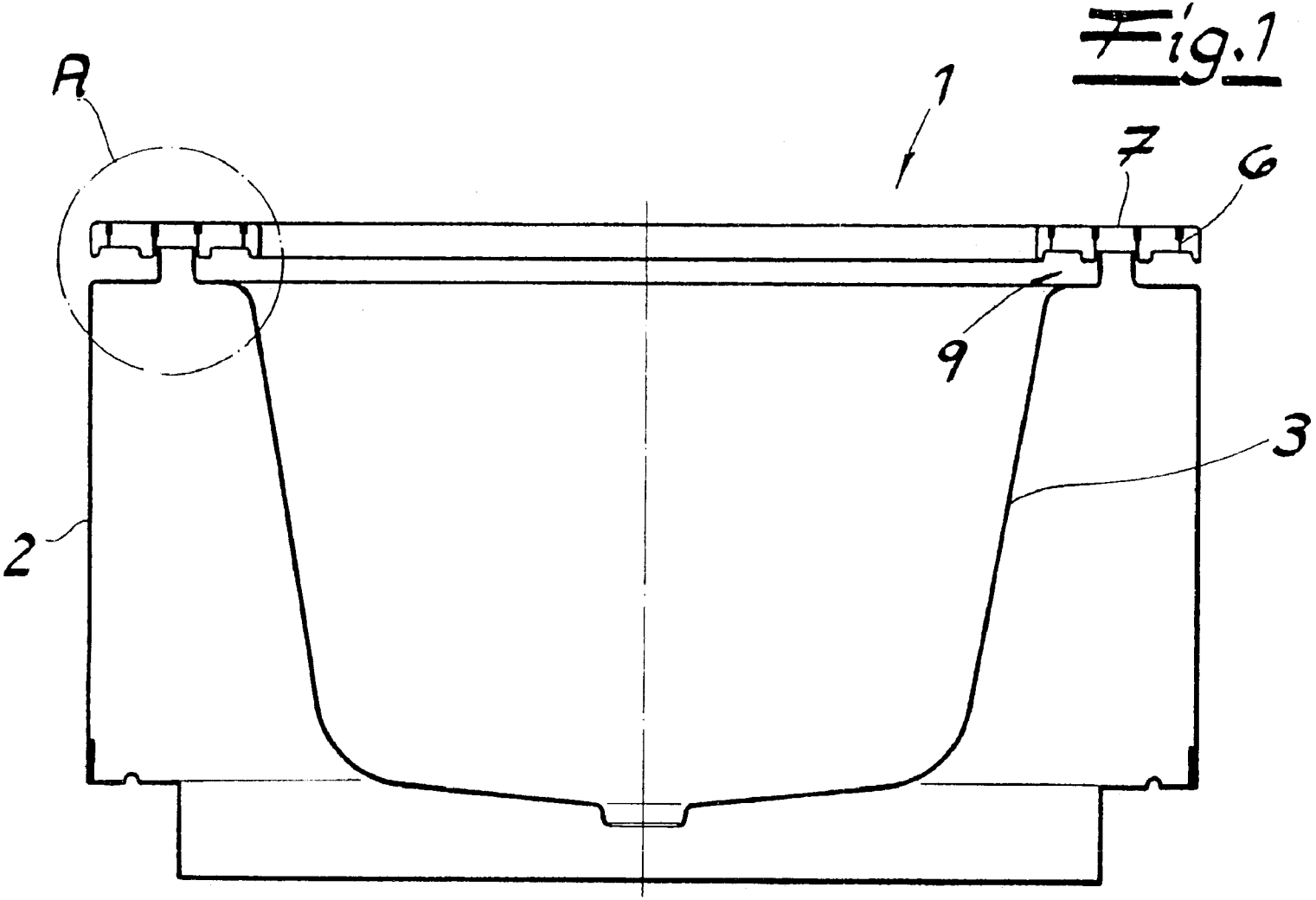
FIG. 1 shows a cross-section through a sanitary tub.
Figure 2:
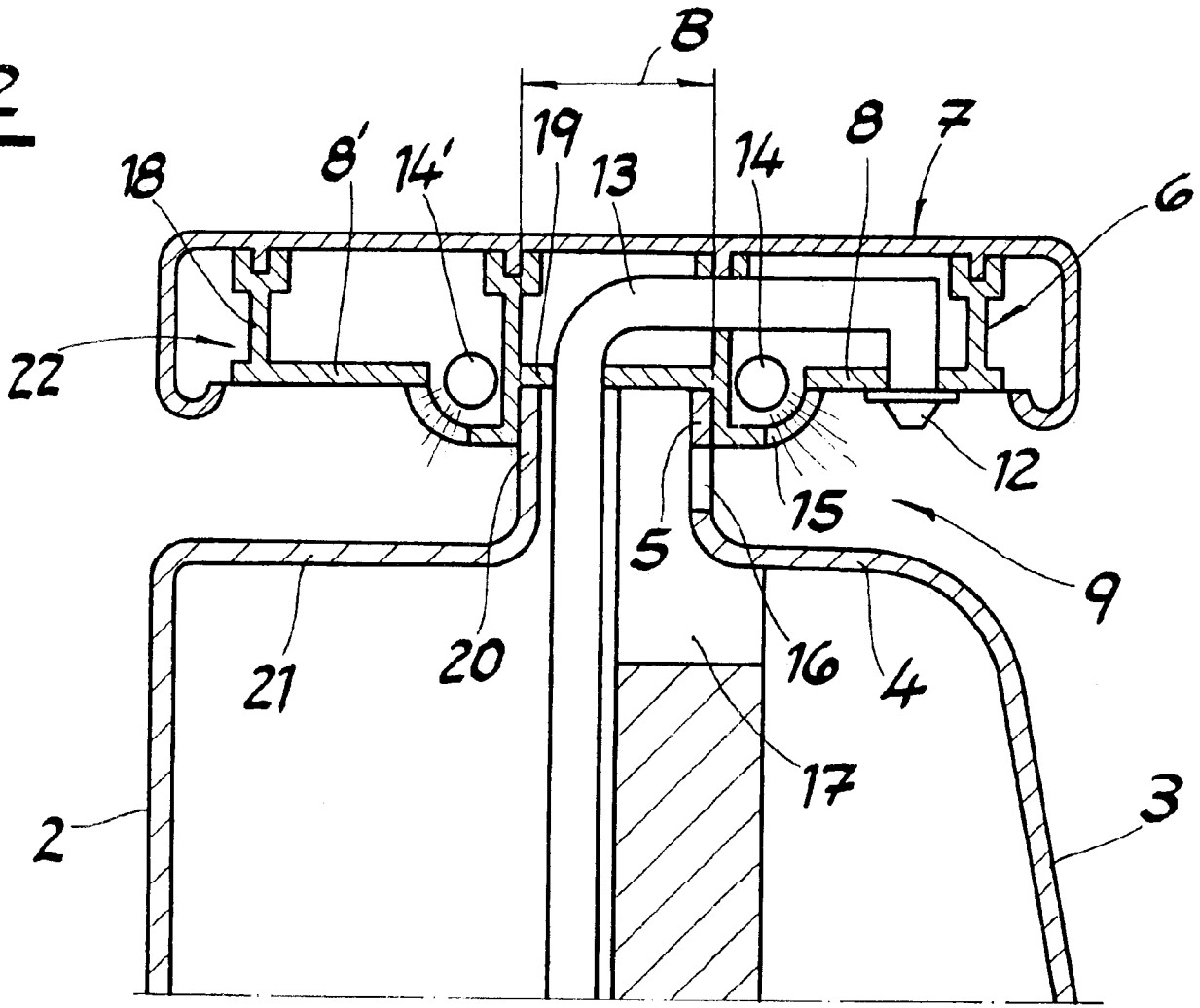
FIG. 2 shows detail A of FIG. 1, on a greater scale as compared with FIG. 1.

Turning now in detail to the drawings, FIG. 1 shows the outlines of a sanitary tub 1 having a tub paneling 2. As shown in FIG. 2, the sanitary tub 1 consists of a tub body 3 having a tub edge 4 that is turned towards the outside, which ends with an up-drawn collar 5 on the circumference. A carrier 6 having a tub edge covering 7, which can be variably structured with regard to material, color, and design, is attached to the collar 5.

Plastic or metal profiles, wood profile strips, elastically resilient molded bodies or, if applicable, natural stone elements can be used as the tub covering 7. The carrier 6 has a bottom edge 8 arranged at a distance above the tub edge 4 which, together with tub edge 4, forms a groove 9 that is open towards the interior of the tub body. Groove 9 can be used for hanging bath furniture 10, as shown as an example in FIG. 4. The bath furniture 10 has guide tabs 11 that engage in the groove 9 between the carrier 6 and the tub edge 4.

As shown in FIG. 2 and FIG. 3, carrier 6 forms an installation space for electrical installations and/or water transport installations, wherein functional elements of these installations can be arranged on bottom edge 8 of carrier 6. In an exemplary embodiment, cleaning jets 12 are arranged at the bottom edge 8 of carrier 6 and are connected with lines 13 for liquid that are laid in the installation space of carrier 6. Furthermore, a device 14 for illuminating the tub interior is housed in the installation space of carrier 6. Carrier 6 contains light exit openings 15. Because the light exit openings 15 are arranged in the interior of groove 9, and covered, the light that is emitted is glare-free. The arrangement can be made so that the light exits from groove 9 as a band of light. In an exemplary embodiment, the up-drawn collar 5 of the tub edge furthermore contains one or more overflow openings 16, to which an overflow channel 17 is connected.

Carrier 6 has ribs 18 having connector formations to attach tub edge covering 7 to the tub body. In this connection, tub edge covering 7 is configured as a handle profile, which surrounds the bottom edge of carrier 6. As shown in FIG. 2 and FIG. 3, carrier 6 may have a connection segment 19 that is U-shaped in cross-section, which surrounds the top edge of collar 5 formed on tub edge 4, and has a width B that is sufficient for passing lines through.

In the exemplary embodiment of FIG. 1 and FIG. 2, carrier 6 is set onto collar 5 of tub edge 4 as well as onto tub paneling 2, whereby a connection end of tub paneling 2 has an attachment collar 20 and a projection 21 that connect with the latter. Carrier 6 has a segment 22 that projects towards the tub exterior, a bottom edge 8' of which is arranged at a distance from projection 21 of tub paneling 2. A device 14' for exterior illumination of the sanitary tub is arranged on a bottom edge 8' of carrier segment 22, which is arranged at a distance above projection 21 of tub paneling 2. Furthermore, tub accessories, such as tub handles and entry aids, small tray tables, and the like, can be attached in the groove delimited by carrier 6 and projection 21 of tub paneling 2.

As shown in FIG. 2, carrier 6 has a connection segment 19 that is U-shaped in cross-section, which surrounds collar 5 of tub edge 4 and attachment collar 20 of tub paneling 2 at least at the edge, and has a width B sufficient for passing lines there through. To attach carrier 6 to sanitary tub 1, as well as to tub paneling 2, clamp elements, which are inserted between attachment collar 20 of tub paneling 2 and collar 5 of tub edge 4 can be used.

In the exemplary embodiment shown in FIG. 3, carrier 6 also has a connection segment 19 that is U-shaped in cross-section, which surrounds the top edge of collar 5 formed on tub edge 4 and has a width B that is sufficient for passing lines through. Shank 24 of U-shaped connection segment 19 lies on the outside of the tub and has a shank length, in cross-section, that at least corresponds to the height of collar 5 formed on tub edge 4. Carrier 6 can be attached to sanitary tub 1 by means of clamp elements that are inserted between up-drawn collar 5 of tub edge 4 and shank 24 of carrier 6 that lies on the outside of the tub. Furthermore, tub paneling 2 can be attached to the outside of shank 24.

Accordingly, while several embodiments of the present invention have been shown and described, it is to be understood that many changes and modifications may be made thereunto without departing from the spirit and scope of the invention as defined in the appended claims.

What is claimed:

1. A sanitary tub comprising:

(a) a tub body defining an interior and an exterior of the sanitary tub;

(b) a tub edge integrally formed with said tub body and disposed on a perimeter of said tub body in a substantially horizontal orientation and turned toward the exterior of the sanitary tub;

(c) a collar integrally formed with said tub body and disposed on a circumference of said tub edge in a substantially vertical orientation;

(d) a carrier secured to said collar, said carrier having a bottom edge arranged at a distance above said tub edge; and (e) a tub edge covering secured to said carrier;

wherein said bottom edge of said carrier and said tub edge form a groove which is open toward the interior of the sanitary tub.

2. The sanitary tub according to claim 1, wherein said carrier forms an installation space for receiving a functional element for an electrical or water installation which is arranged on said bottom edge of said carrier.

3. The sanitary tub according to claim 2, wherein said electrical or water installation comprises a cleaning jet connected to a liquid line.

4. The sanitary tub according to claim 2, wherein said electrical or water installation comprises a device for illuminating the interior of the sanitary tub.

5. The sanitary tub according to claim 1, wherein said collar further comprises at least one overflow opening connected to an overflow channel.

6. The sanitary tub according to claim 1, wherein said carrier further comprises ribs having connector formations for securing said tub edge covering to said carrier.

7. The sanitary tub according to claim 1, wherein said tub edge covering has a handle profile which surrounds said bottom edge of said carrier.

8. The sanitary tub according to claim 1, wherein said tub edge covering comprises a material selected from the group consisting of: plastic, metal, wood, natural stone and elastically resilient molded materials.

9. The sanitary tub according to claim 1, wherein said carrier further comprises a connection segment having a U-shaped cross-section and surrounding a top edge of said collar, wherein said connection segment has a width sufficient to allow lines to pass through.

10. The sanitary tub according to claim 9, further comprising a shank disposed at the exterior of the sanitary tub adjacent to said collar, wherein said shank has a length which is at least as long as a length of said collar and wherein said carrier is secured to the sanitary tub by means of clamp elements inserted between said collar and said shank.

11. The sanitary tub according to claim 1, further comprising:

(a) a set of panels forming a tub paneling coupled to said tub body;

(b) a projection disposed on said tub paneling in a substantially horizontal orientation; and (c) an attachment collar disposed on a circumference of said projection in a substantially vertical orientation;

wherein said carrier further comprises a segment projecting toward the exterior of the sanitary tub, said segment having a bottom edge arranged at a distance above said projection;

wherein said bottom edge of said segment and said projection form a groove; and wherein said carrier is set onto said collar of said tub edge and said attachment collar of said projection.

12. The sanitary tub according to claim 11, further comprising a device for illuminating the exterior of the sanitary tub disposed at a distance above said projection of said tub paneling.

13. The sanitary tub according to claim 11, further comprising tub accessories attached at said groove formed by said bottom edge of said segment and said projection.

14. The sanitary tub according to claim 11, wherein said carrier further comprises a connection segment having a U-shaped cross-section and surrounding at least an edge of said collar of said tub edge and said attachment collar of said projection, wherein said connection segment has a width sufficient to allow lines to pass through, and wherein said carrier is secured to the sanitary tub and said tub paneling by means of clamp elements inserted between said collar of said tub edge and said attachment collar of said projection.

15. A sanitary tub comprising:

(a) a tub body defining an interior and an exterior of the sanitary tub;

(b) a tub edge integrally formed with said tub body and disposed on a perimeter of said tub body in a substantially horizontal orientation and turned toward the exterior of the sanitary tub;

(c) a collar integrally formed with said tub body and disposed on a circumference of said tub edge in a substantially vertical orientation;

(d) a set of panels forming a tub paneling coupled to said tub body;

(e) a projection disposed on said tub paneling in a substantially horizontal orientation;

(f) an attachment collar disposed on a circumference of said projection in a substantially vertical orientation;

(g) a carrier set onto said collar of said tub edge and said attachment collar of said projection, said carrier having a bottom edge arranged at a distance above said tub edge, and said carrier having a segment projecting toward the exterior of the sanitary tub, said segment having a bottom edge arranged at a distance above said projection; and (h) a tub edge covering secured to said carrier;

wherein said bottom edge of said segment and said projection form a groove which is open toward the exterior of the sanitary tub and said bottom edge of said carrier and said tub edge form a groove which is open toward the interior of the sanitary tub.

* * * * *